US007442080B1

(12) United States Patent
Tsen

(10) Patent No.: US 7,442,080 B1
(45) Date of Patent: Oct. 28, 2008

(54) ELECTRIC CONNECTOR HAVING SEGMENTED CENTER CONTACT MEMBER

(75) Inventor: Yu Ching Tsen, Tauyuan Hsien (TW)

(73) Assignee: Joymax Electronics Co., Ltd., Chongli Gonyeh Chu, Chongli Tauyuan Hsien (TW)

( * ) Notice: Subject to any disclaimer, the term of this patent is extended or adjusted under 35 U.S.C. 154(b) by 0 days.

(21) Appl. No.: 11/903,544

(22) Filed: Sep. 21, 2007

(51) Int. Cl.
*H01R 9/05* (2006.01)

(52) U.S. Cl. ..... 439/578; 439/88; 439/181

(58) Field of Classification Search ..... 439/578, 439/88, 97, 181, 654, 580, 186, 187
See application file for complete search history.

(56) References Cited

U.S. PATENT DOCUMENTS 4,037,909 A 7/1977 Trompeter et al. ..... 339/177 R
4,206,963 A * 6/1980 English et al. ..... 439/581
4,720,271 A 1/1988 Grange ..... 439/271
5,062,808 A * 11/1991 Hosler, Sr. ..... 439/580
5,183,411 A 2/1993 Yu ..... 439/578
5,704,809 A * 1/1998 Davis ..... 439/578

* cited by examiner

*Primary Examiner*—Hae Moon Hyeon
(74) *Attorney, Agent, or Firm*—Charles E. Baxley

(57) ABSTRACT

An electric connector includes two couplers attached to two end portions of a housing, a center contact member disposed in the housing and the couplers, one or more insulators disposed in the housing for insulating and spacing the center contact member from the housing and the couplers and for preventing the center contact member from electrically contacting with the housing and the couplers, and a lightening discharger disposed in the housing and coupled to the center contact member, and the center contact member includes at least two contact segments having different diameter for increasing the impedance matching and for reducing the signal loss or energy leakage or gain loss.

10 Claims, 4 Drawing Sheets

ELECTRIC CONNECTOR HAVING SEGMENTED CENTER CONTACT MEMBER

BACKGROUND OF THE INVENTION

1. Field of the Invention

The present invention relates to an electric connector, and more particularly to an electric connector including an excellent high frequency impedance matching for preventing the gain from quickly decay and for allowing the electric connector to be used for a wide range of frequencies.

2. Description of the Prior Art

Typical electric connectors comprise an outer shell and a coaxial cable or center contact member disposed in the outer shell for radio and television reception and similar transmission systems operating at radio frequencies.

For example, U.S. Pat. No. 4,037,909 to Trompeter et al., U.S. Pat. No. 4,720,271 to Grange, and U.S. Pat. No. 5,183,411 to Yu disclose three of the typical coaxial cables each including a central contact engaged in an outer housing for telescopic current transmitting engagement with the shell of a mating connector, and for being operated at various radio frequencies for the radio and television reception and transmission systems.

It is important that maximum energy transfer takes place with a minimum amount of signal loss or energy leakage.

However, a large amount of signal loss or energy leakage may be occurred or generated in the typical coaxial cables, or the gain may quickly decay particularly in the higher frequencies such that the typical coaxial cables may not be used for a wide range of frequencies.

The present invention has arisen to mitigate and/or obviate the afore-described disadvantages of the conventional electric connectors.

SUMMARY OF THE INVENTION

The primary objective of the present invention is to provide an electric connector including an excellent high frequency impedance matching for preventing the gain from quickly decay and for allowing the electric connector to be used for a wide range of frequencies.

In accordance with one aspect of the invention, there is provided an electric connector comprising a housing including a chamber formed therein, and including two end portions, two couplers attached and engaged with the end portions of the housing respectively, a center contact member disposed in the chamber of the housing and extended in the couplers, at least one insulator disposed in the housing for insulating and spacing the center contact member from the housing and the couplers and for preventing the center contact member from electrically contacting with the housing and the couplers, and a lightening discharger disposed in the chamber of the housing and coupled to the center contact member, and the center contact member includes a first contact segment and at least one second contact segment each having an outer diameter different from an outer diameter of the center contact member for increasing the impedance matching and for preventing the signal loss or the energy leakage or the gain loss from being occurred or generated in the electric connector.

The insulator is preferably disposed between the couplers and the center contact member. The first contact segment includes an outer diameter greater than an outer diameter of the center contact member, and the second contact segment preferably includes an outer diameter greater than the outer diameter of the first contact segment.

The center contact member includes two contact elements having an inner end detachably coupled together. The inner end of the contact elements are detachably coupled together with a fastening device.

The housing includes a cap detachably coupled to the housing for engaging the lightening discharger into the chamber of the housing and for retaining the lightening discharger between the housing and the center contact member.

The housing includes a spring member disposed between the lightening discharger and the cap for biasing the lightening discharger toward and to engage with the center contact member. The housing includes a connecting member attached to the housing for coupling with a ground cable.

Alternatively, the housing includes a plurality of contact segment each having an outer diameter different from an inner diameter of the housing.

The housing includes a ring member disposed in the housing and having the contact segment provided in the ring member. The insulator is disposed and engaged between the ring member and the center contact member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
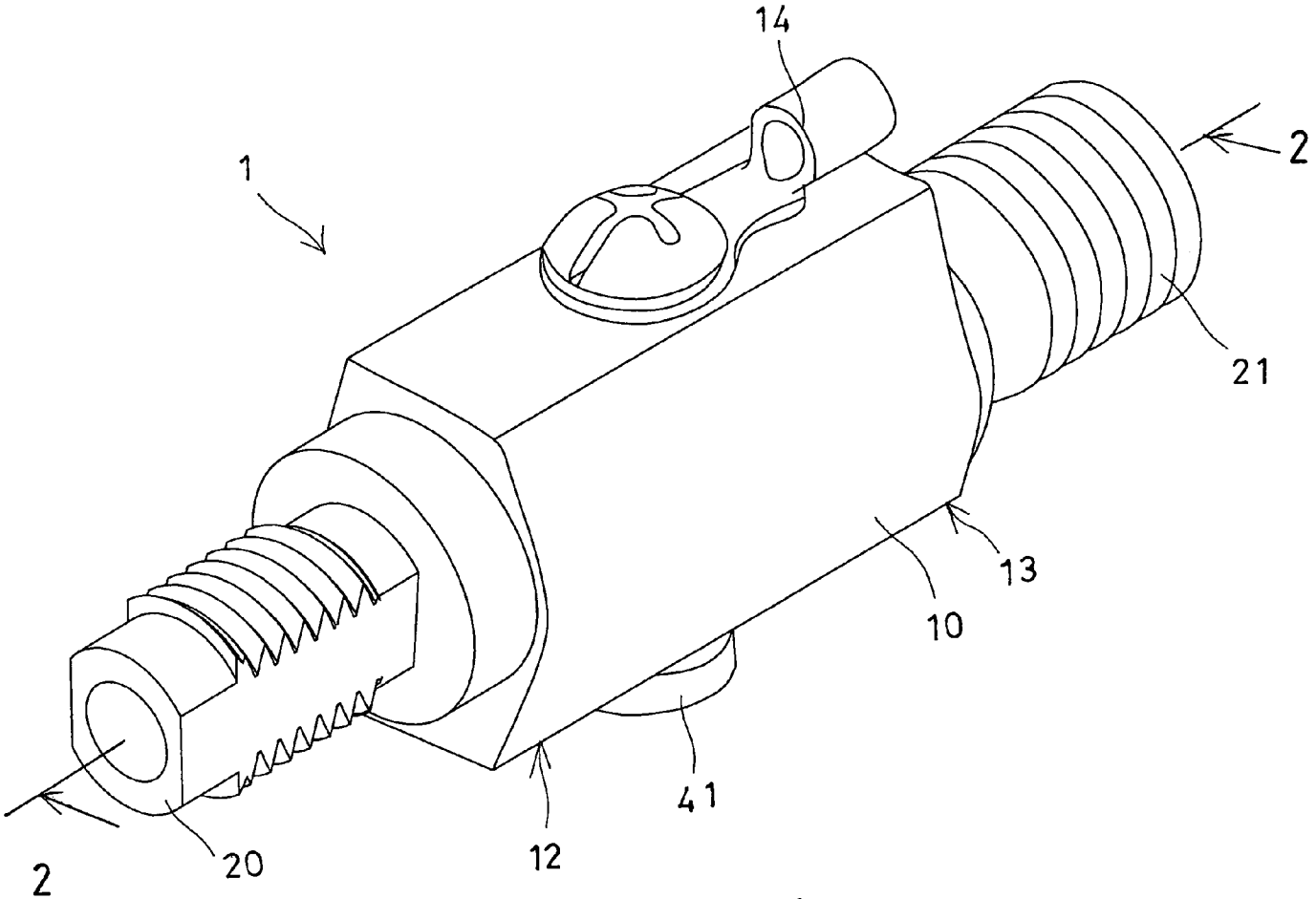
FIG. 1 is a perspective view of an electric connector in accordance with the present invention.
Figure 2:
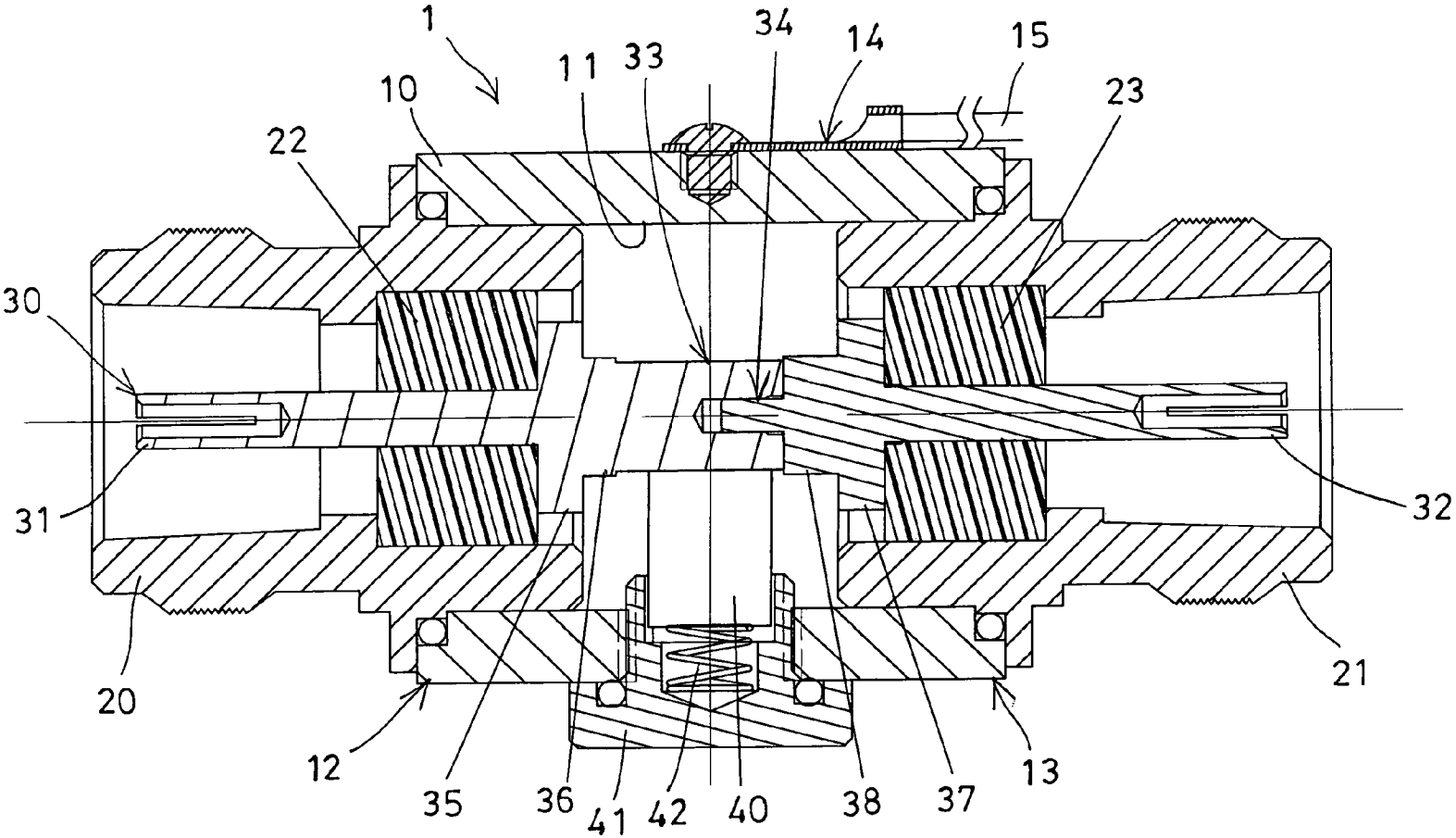
FIG. 2 is a cross sectional view of the electric connector taken along lines 2-2 of FIG. 1.

Referring to the drawings, and initially to FIGS. 1 and 2, an electric connector 1 in accordance with the present invention is provided for radio and television reception and similar transmission systems operating at radio frequencies and comprises an outer shell or housing 10 including a chamber 11 formed therein, and including two end portions 12, 13 for attaching or engaging with couplers 20, 21 respectively, and a connecting member 14 attached or coupled to the housing 10 for coupling or securing or engaging with an electric cable 15, such as a ground cable 15 and for such as grounding purposes.

As shown in FIG. 2, a center contact member 30 is disposed in the chamber 11 of the housing 10 and also extended or received or disposed in the couplers 20, 21, and one or more (such as two) spacers or insulators 22, 23 are disposed or engaged between the housing 10 or the couplers 20, 21 and the center contact member 30 for insulating or spacing the center contact member 30 from the housing 10 or the couplers 20, 21 and for preventing the center contact member 30 from electrically contacting with the housing 10 or the couplers 20, 21. The above-described structure is typical and will not be described in further details.

One or more lightening dischargers 40 are also disposed in the chamber 11 of the housing 10 and coupled to the center contact member 30 for lightening discharging or arresting purposes, and one or more caps 41 may be detachably or openably attached or coupled to the housing 10 for engaging the lightening dischargers 40 into the chamber 11 of the housing 10 and for retaining the lightening dischargers 40 between the housing 10 and the center contact member 30, and one or more spring members 42 are disposed or engaged between the lightening dischargers 40 and the caps 41 for biasing or forcing the lightening dischargers 40 toward or to engage with the center contact member 30.

The center contact member 30 includes two contact elements 31, 32 having one end or inner end 33 detachably coupled together with such as a threading engagement or a fastening device 34 or the like, and includes one or more contact portions or segments 35, 36, 37, 38 formed or provided on each of the contact elements 31, 32 and having an outer diameter smaller than or greater than or different from the outer diameter of the center contact member 30 for increasing the impedance matching and for preventing the signal loss or the energy leakage or the gain loss from being occurred or generated in the electric connector 1 in accordance with the present invention. For example, the contact segments 36, 38 include an outer diameter greater than the outer diameter of the center contact member 30, and the other contact segments 35, 37 include an outer diameter greater than the outer diameter of the contact segments 36, 38.

Figure 3:
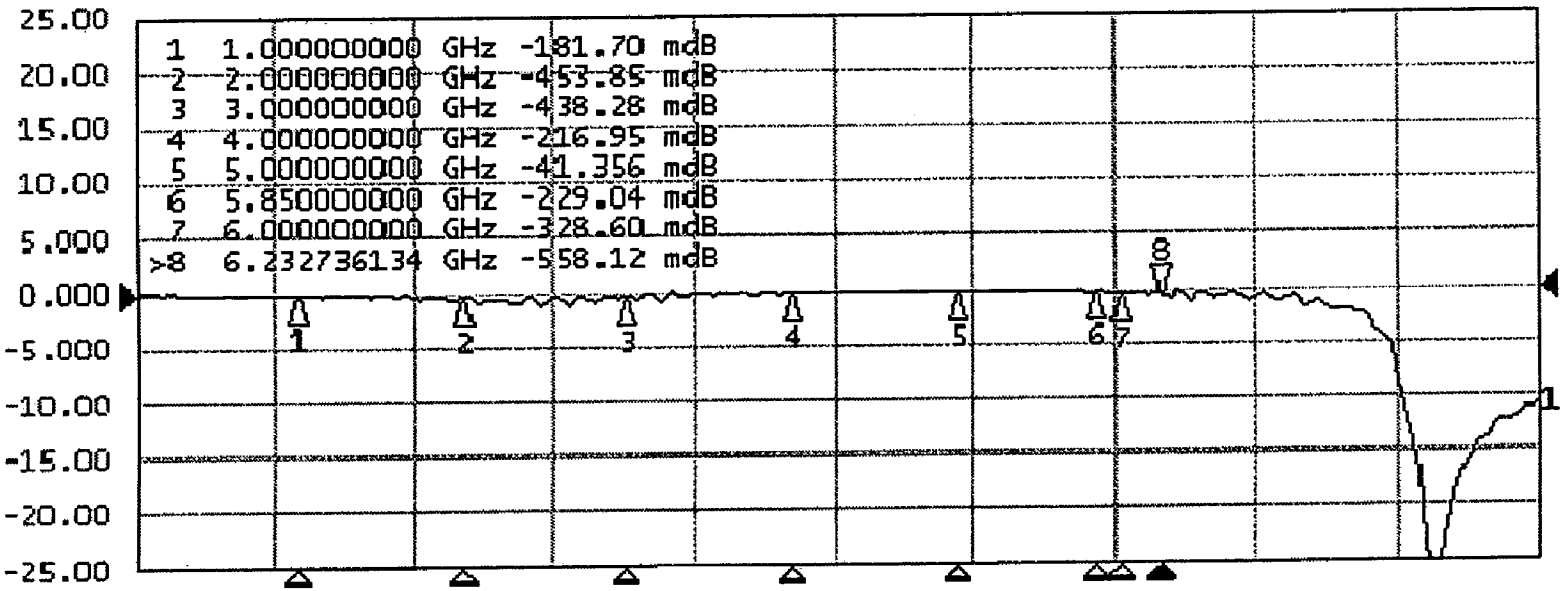
FIG. 3 is a chart illustrating the frequencies and the gain decay for the electric connector in accordance with the present invention.

For example, as shown in FIG. 3, after the test with different frequencies, no gain loss has been occurred or generated between 0-6 GHz, i.e., the radio and television reception or transmission operations at high radio frequencies between 0-6 GHz are stable or stabilized, such that the electric connector 1 in accordance with the present invention may be suitably operated within a wider range of frequencies.

Figure 4:
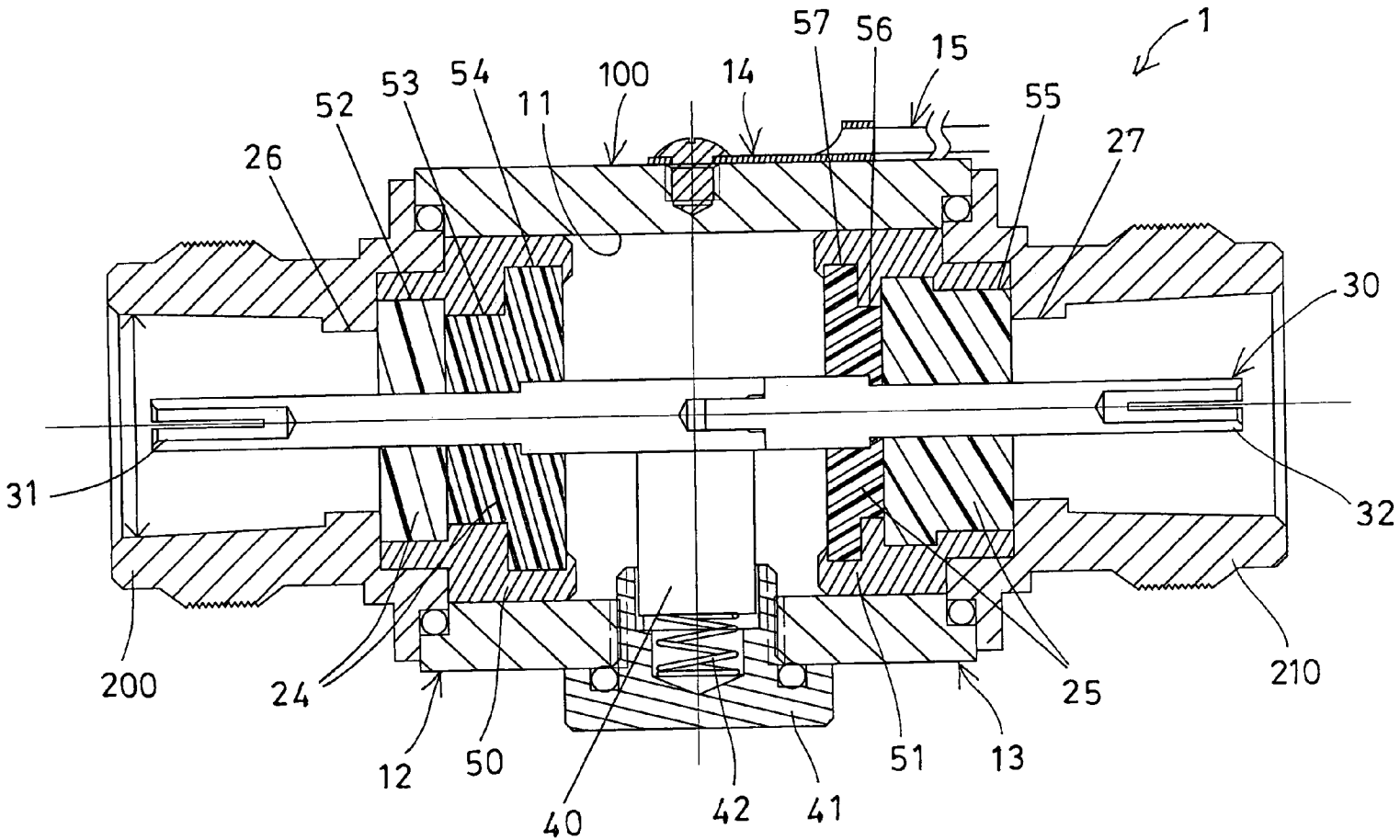
FIG. 4 is a perspective view similar to FIG. 1, illustrating the other arrangement of the electric connector.

Alternatively, as shown in FIG. 4, the housing 100 may include one or more (such as two) ring members 50, 51 disposed or engaged therein and/or engaged in the couplers 200, 210, and one or more spacers or insulators 24, 25 disposed or engaged between the housing 100 or the ring members 50, 51 and the center contact member 30, and the ring members 50, 51 and/or the couplers 200, 210 each may include one or more contact portions or segments 52, 53, 54, 55, 56, 57, 26, 27 formed or provided therein and having an inner diameter different from each other or smaller than or greater than or different from the inner diameter of the ring members 50, 51 and/or the couplers 200, 210 for increasing the impedance matching and for preventing the signal loss or the energy leakage or the gain loss from being occurred or generated in the electric connector 1. The ring members 50, 51 may be formed integral as one-piece with the housing 100 and/or the couplers 200, 210.

Accordingly, the electric connector in accordance with the present invention includes an excellent high frequency impedance matching for preventing the gain from quickly decay and for allowing the electric connector to be used for a wide range of frequencies.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An electric connector comprising:

a housing including a chamber formed therein, and including two end portions, two couplers attached and engaged with said end portions of said housing respectively, a center contact member disposed in said chamber of said housing and extended in said couplers, at least one insulator disposed in said housing for insulating and spacing said center contact member from said housing and said couplers and for preventing said center contact member from electrically contacting with said housing and said couplers, and a lightening discharger disposed in said chamber of said housing and coupled to said center contact member, and said center contact member including a first contact segment and at least one second contact segment, and said first contact segment including an outer diameter different from an outer diameter of said at least one second contact segment.

2. The electric connector as claimed in claim 1, wherein said at least one insulator is disposed between said couplers and said center contact member.

3. The electric connector as claimed in claim 1, wherein said center contact member includes two contact elements having an inner end detachably coupled together.

4. The electric connector as claimed in claim 3, wherein said inner end of said contact elements are detachably coupled together with a fastening device.

5. The electric connector as claimed in claim 1, wherein said housing includes a cap detachably coupled to said housing for engaging said lightening discharger into said chamber of said housing and for retaining said lightening discharger between said housing and said center contact member.

6. The electric connector as claimed in claim 5, wherein said housing includes a spring member disposed between said lightening discharger and said cap for biasing said lightening discharger toward and to engage with said center contact member.

7. The electric connector as claimed in claim 1, wherein said housing includes a connecting member attached to said housing for coupling with a ground cable.

8. An electric connector comprising:

a housing including a chamber formed therein, and including two end portions, two couplers attached and engaged with said end portions of said housing respectively, a center contact member disposed in said chamber of said housing and extended in said couplers, at least one insulator disposed in said housing for insulating and spacing said center contact member from said housing and said couplers and for preventing said center contact member from electrically contacting with said housing and said couplers, and a lightening discharger disposed in said chamber of said housing and coupled to said center contact member, and said housing including a plurality of contact segment each having an outer diameter different from an inner diameter of said chamber of said housing.

9. The electric connector as claimed in claim 8, wherein said housing includes a ring member disposed in said housing and having said contact segment provided in said ring member.

10. The electric connector as claimed in claim 9, wherein said at least one insulator is disposed and engaged between said ring member and said center contact member.

* * * * *